US005588457A

United States Patent [19]

Tartaglia

[11] Patent Number: 5,588,457

[45] Date of Patent: Dec. 31, 1996

[54] ROLLER CANE TO AID THE HANDICAPPED PERSON IN WALKING AND IN MANEUVERING

[76] Inventor: John A. Tartaglia, 108 Stoddard Rd., Waterbury, Conn. 06708

[21] Appl. No.: 341,639

[22] Filed: Nov. 17, 1994

[51] Int. Cl.[6] ..... A61H 3/02

[52] U.S. Cl. ..... 135/85; 135/912; 280/47.34

[58] Field of Search ..... 135/84, 85, 65, 135/912, 66, 77; 280/47.34

[56] References Cited

U.S. PATENT DOCUMENTS

| | | | |
|---|---|---|---|
| 1,307,058 | 6/1919 | McGrath | 135/85 X |
| 3,996,950 | 12/1976 | Mier | 135/85 X |
| 4,559,962 | 12/1985 | Marchiano | 135/85 |
| 4,635,951 | 1/1987 | Berfield et al. | 280/47.34 |
| 4,962,781 | 10/1990 | Kanbar | 135/85 X |
| 5,046,748 | 9/1991 | Oat-Judge | 280/47.34 |
| 5,056,545 | 10/1991 | Spaeth | 135/85 X |
| 5,228,716 | 7/1993 | Dahl | 280/47.34 X |
| 5,299,816 | 4/1994 | Braucke et al. | 280/47.34 X |

FOREIGN PATENT DOCUMENTS

| | | | |
|---|---|---|---|
| 517452 | 10/1955 | Canada | 135/85 |
| 2646329 | 11/1990 | France | 135/85 |
| 720898 | 5/1942 | Germany | 135/85 |
| 219031 | 1/1942 | Switzerland | 135/85 |

*Primary Examiner*—Carl D. Friedman
*Assistant Examiner*—Beth A. Aubrey

[57] ABSTRACT

A useful cane assembly for the handicapped for walking and maneuvering with ease, having the person's weight on the cane assembly being continuously supported. Cane 1, is supported by base 4, which is on wheels 5 and 6.

3 Claims, 1 Drawing Sheet

ROLLER CANE TO AID THE HANDICAPPED PERSON IN WALKING AND IN MANEUVERING

BACKGROUND ART

Many prior art of canes for the handicapped are available. Accepted practice has been an upright stick or cane, to support the user in walking.

Needless to expand the description and the list of a myriad of different type of canes, since all the canes have been similarly constructed by the same fundamental concept design. All of the above differs from the instant invention.

OBJECT OF THE INVENTION

The object of the invention is to provide a simple device to continually support the handicapped person in walking and maneuvering. The invention allows the weight applied by the handicapped on the cane to be supported from the floor at all times, thus allowing the user to walk in different directions and to maneuver with steady support.

Yet another object of the invention is to provide a cane which does not require to be lifted off the floor in walking and maneuvering.

SUMMARY OF THE INVENTION

The instant invention is essentially a cane mounted on a base, having four wheels, two of which are swivels and two are fixed. The four wheels are positioned on the base within a configuration for stability in walking and maneuverability.

DETAILED DESCRIPTION

The inventive system comprises a conformable cane assembly for supporting the handicapped person and a conformable base with wheels.

Figure 1:
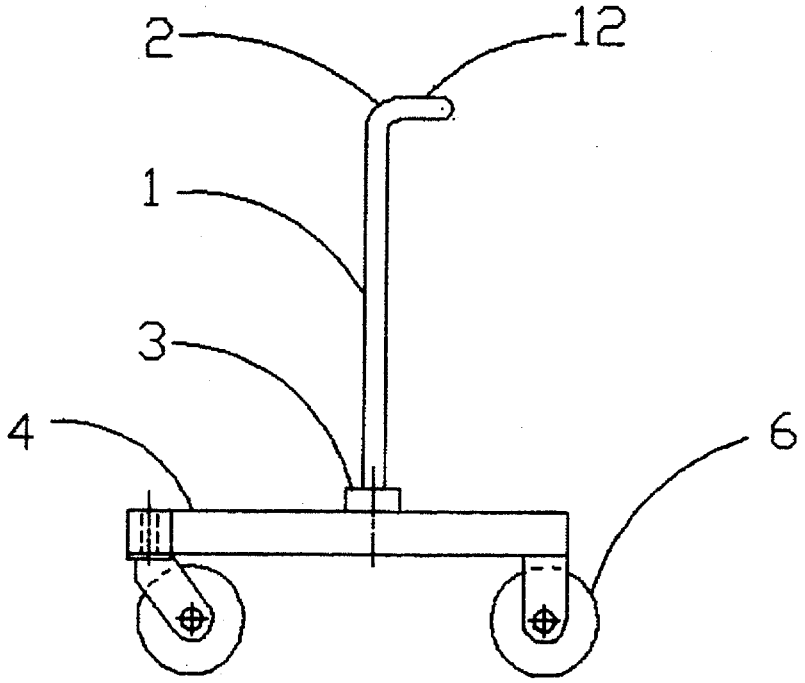
FIG. 1 is a side view of the roller cane showing the components of the system embodying the invention.

Cane assembly 12, FIG. 1, shown and described in its normal condition, is made up of a cylindrical tube 1, having a curve 2 at the upper part for hand gripping, and a suitable fitting 3 at the bottom to attach to the base 4, as to make one solid assembly. Wheels 5 are attached to the base 4, and they are the front wheels and of the swivel type. Wheels 6 are attached to the base 4, and are the rear wheels and of the fixed type.

Figure 2:
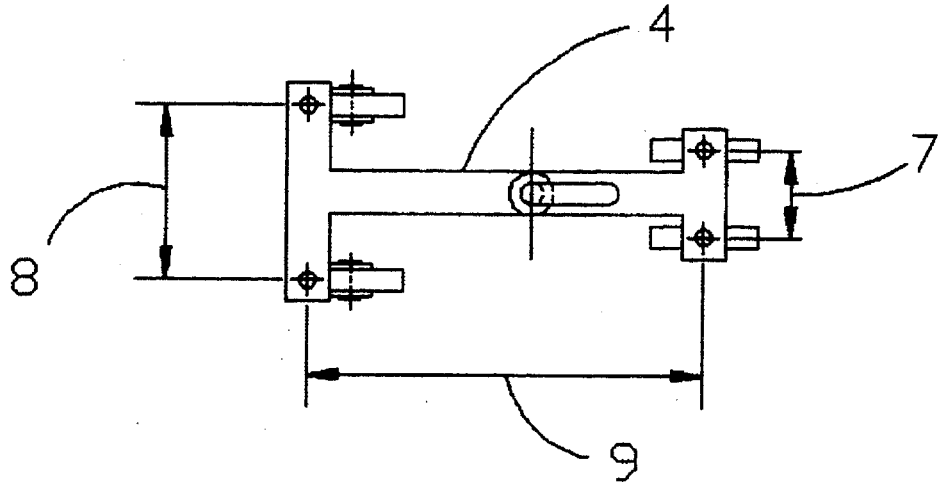
FIG. 2 is a plan view, from the top, showing the geometrical configuration of the wheels.

The base and the wheels geometrical configuration, illustrated in FIG. 2, are positioned in a specific way as to provide maneuverability in the swivel wheels and the stability in the fixed wheels. To better emphasize the concept of maneuverability and stability, the ratio between the center distance 9, and the rear wheels axial length 7 has a value of four to one, and the ratio of the axial length of the front pair 8 and rear pair of wheels 7 is two to one. These ratios have shown optimum performance, however slight deviations have functioned satisfactorily.

What is claimed is:

1. A cane assembly comprising a cylindrical tube, a curved handle, and a base bracket, wherein the tube has an upper and lower end, said handle extending from said upper end, said base bracket being attached to said lower end at approximately a mid-point of said bracket, said bracket having a front and rear end, wherein two front swivel wheels are attached to the front end and two fixed rear wheels are attached to said rear end.

2. The cane assembly according to claim 1, the front wheels spaced wider apart than the rear wheels, the ratio of the front axial length to the rear axial length is two to one, and the ratio of their center distance with respect to the rear axial length is four to one.

3. A cane assembly as per claim 2 which always remains in contact with the floor or pavement, without needing to be lifted off the floor to advance walking.

* * * * *